US006935726B2

(12) United States Patent
Watanabe

(10) Patent No.: US 6,935,726 B2
(45) Date of Patent: Aug. 30, 2005

(54) PRINTING HEAD AND INK JET PRINTING APPARATUS WHICH PERFORMS PRINTING WITH THE PRINTING HEAD

(75) Inventor: Yasutomo Watanabe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 32 days.

(21) Appl. No.: 10/617,043

(22) Filed: Jul. 11, 2003

(65) Prior Publication Data

US 2004/0017436 A1 Jan. 29, 2004

(30) Foreign Application Priority Data

Jul. 15, 2002 (JP) ..... 2002-206219

(51) Int. Cl.[7] ..... B41J 2/05
(52) U.S. Cl. ..... 347/58
(58) Field of Search ..... 347/58, 57, 56, 347/55, 54, 61, 50, 44, 47, 63; 399/33, 67, 320

(56) References Cited

U.S. PATENT DOCUMENTS 5,227,812 A 7/1993 Watanabe et al.
5,760,797 A * 6/1998 Koizumi et al. ..... 347/14
6,119,334 A 9/2000 Watanabe et al.
6,132,031 A 10/2000 Watanabe
6,186,613 B1 2/2001 Watanabe
6,241,340 B1 6/2001 Watanabe et al.
6,471,901 B1 10/2002 Kawamura et al.
2002/0089567 A1 7/2002 Sato et al.
2002/0093550 A1 7/2002 Watanabe

FOREIGN PATENT DOCUMENTS

JP 7-144418 6/1995

* cited by examiner

*Primary Examiner*—Raquel Yvette Gordon
(74) *Attorney, Agent, or Firm*—Fitzpatrick, Cella, Harper & Scinto

(57) ABSTRACT

An electrode wiring line is formed on a supporting board which supports a printing element board constituting a printing head, and it is connected with the electrode wiring lines of a flexible board, thereby to interconnect electrode wiring lines which are formed on both the sides of the printing element board in order to feed a signal or the like of identical sort. Thus, a region for the electrode wiring line on one side of the flexible board can be omitted, with the result that the number of the wiring lines of the flexible board can be increased, or the density of these wiring lines can be heightened.

12 Claims, 7 Drawing Sheets

PRINTING HEAD AND INK JET PRINTING APPARATUS WHICH PERFORMS PRINTING WITH THE PRINTING HEAD

This application claims priority from Japanese Patent Application No. 2002-206219 filed Jul. 15, 2002, which is incorporated hereinto by reference.

BACKGROUND OF THE INVENTION

1. Field of the Invention

The present invention relates to a printing head for ejecting ink, and an ink jet printing apparatus which performs printing by means of the printing head. More particularly, the present invention relates to electrical connections in the circuit boards, etc. of the printing head.

2. Description of the Related Art

Ink jet printers or the like, as apparatuses in which printing is performed by ejecting ink onto a printing medium, are widely used. Such an ink jet printing apparatus includes a printing head for ejecting the ink Besides, signals such as a head drive signal are exchanged between the printing head and an apparatus main body, and the electric power of a power source is supplied from the apparatus main body to the printing head.

FIG. 5 is an exploded perspective view showing a printing head in a prior-art example. The printing head shown in the figure is of the so-called "side shooter type" wherein ink is ejected in a direction perpendicular to a substrate of the printing head on which heaters or the like are disposed.

As shown in FIG. 5, a printing head 100 is generally made of a body 18, a printing element board 10, a supporting board 20 and a printed wiring board 30. The printing element board 10 has ink ejection orifices, a substrate which is formed with heaters for generating energy for ejecting ink from the orifice, and the like. The supporting board 20 is attached to the body 18 in a state where the supporting board supports the board 10. The printed wiring board 30 is disposed so as to surround the printing element board 10, and drive signals for ejecting ink, etc. and supply power are fed to the board 10 through wiring lines laid in the board 30. The body 18 is provided with an ink supply portion 180, an electrical connection portion 181, etc. The ink supply portion 180 has an ink tank IT detachably attached thereto, and the portion forms an ink supply passage from the attached ink tank to the printing element board 10. The electrical connection portion 181 comes into contact with an electrical connection portion of a carriage (not shown) when the printing head 100 is mounted on the carriage, whereby the electrical connections of the printing head 100 with the apparatus main body can be made.

The body 18 is so configured that the above portions such as the ink supply portion 180 are unitarily molded by, for example, a resin. The ink supply portion 180 has a recess portion 182G for receiving the supporting board 20 therein. The bottom of the recess portion 182G is a surface used as a joint surface 183 on which the supporting board 20 is bonded. As shown in FIGS. 6A and 6B, a part of the joint surface 183 is formed of the surfaces of block pieces 26 which are formed of, for example, an aluminum alloy. The block pieces 26 are disposed in a metal mold when the body 18 is molded with the metal mold, whereby they can be covered with the resin forming the body 18. The end of the ink supply passage 184 for introducing the ink from the ink tank IT is an opening at substantially the central part of the joint surface 183.

The substrate forming the printing element board 10 is a thin film of silicon material having a thickness of 0.5 mm–1.0 mm. Besides, the substrate is formed with an opening which communicates with the above-mentioned ink supply port 184 through the opening 20*a* of the supporting member 20, as shown in FIG. 5. In addition, heaters and partition walls dividing the heaters are respectively disposed in correspondence with a plurality of ink ejection orifices on both the sides of the opening 10*c* on the substrate. Thus, the ink supplied from the ink tank IT is fed into respective ink paths provided with the corresponding heaters.

As shown in FIG. 5 and FIGS. 6A, 6B, the printed wiring board 30 is electrically connected to the printing element board 10. The printed wiring board 30 has a printing-element accommodation portion 10B in which the printing element board 10 is accommodated for the electrical connections, and an input terminal portion 10A which is disposed in the electrical connection portion 181 of the body 18. The electrical connections between the printed wiring board 30 and the printing element board 10 are done using a TAB (tape automated bonding) method.

The supporting board 20, which is arranged between the printing element board 10 and the joint surface 183 of the recess portion 182G in the ink supply portion 180, is formed in the shape of a rectangular plate, as shown in FIG. 5 and FIGS. 6A, 6B. The supporting board 20 is formed of silicon which is the same material as that of the substrate forming the printing element board 10. Incidentally, this material is not restrictive, but the supporting board 20 can also be formed of a material which exhibits a linear expansion coefficient equivalent to that of the material of the printing element board 10, and a thermal conductivity equivalent to or higher than that of the material of the printing element board 10. By way of example, the material of the supporting board 20 may be any of alumina ($Al_2O_3$), aluminum nitride (AlN), silicon carbide (SiC), trisilicon tetranitride ($Si_3N_4$), molybdenum (Mo) and tungsten (W).

As shown in FIG. 6A, the supporting board 20 has a second joint surface 20Sa which is bonded onto the surface provided with the ink supply opening 10*c* in the printing element board 10, and a first joint surface 20Sb which is bonded onto the joint surface 183 of the recess portion 182G in the ink support portion 180. Besides, the supporting board 20 has a communicating passage 20*a* formed to extend in the lengthwise direction of this board 20, at a position which corresponds to both the ink supply opening 10*c* and the ink supply passage 184 provided in the joint surface 183. Further, the lengths of the shorter side and the longer side of the supporting board 20 are respectively the same as those of the shorter side and longer side of the printing element board 10, and the thicknesses of both the boards 20 and 10 are substantially the same.

In disposing in the body 18 the printing element board 10 to which the printed wiring board 30 is connected, the first joint surface 20Sb of the support board 20 is initially bonded to the predetermined position of the joint surface 183 by an adhesive. Subsequently, as shown in FIG. 6B, the second joint surface 20Sa of the support board 20 is bonded by the adhesive onto the surface provided with the ink supply opening 10*c* in the printing element board 10. Usable as the adhesive is, for example, one which has a low viscosity, which can form a thin bonding layer on the bonding surface, and which exhibits a comparatively high hardness after having been set.

In the printing head configured as described above, when heater drive signals corresponding to printing information are fed to the heaters of the printing element board 10 through the printed wiring board 30, the heater generates heat and thus an air bubble is generated in the ink, and thereby the ink is ejected by the pressure of the air bubble.

An example of the prior-art printing head as described above is shown in Japanese Patent Application Laid-open No. 07-144418(1995). However, the electrical connections of such a prior art between the printing element board and the printed wiring board has involved several technical problems as stated below.

In the first place, since the TAB method is employed as a method for connecting electrode wiring lines of both the boards, multi-layering of the electrode wiring lines in the printed wiring board is difficult, and the multi-layering is very difficult especially in case of arranging electrode wiring lines at a high density. Therefore, the electrode wiring lines of, for example, the above-mentioned flexible board (printed wiring board) are often laid as wiring lines of single layer. As a result, the number of the wiring lines in the flexible board has a certain limitation, and the sorts of signals which can be fed to the printing head through the flexible board are also limited.

In order to cope with the above drawback, it is considered to heighten a wiring density with the intention of increasing the number of wiring lines, but the intervals of the wiring lines need to be shorten accordingly (to, for example, 100 $\mu$m or less). Since, in this case, the wiring lines are formed at the very small intervals, a process for the formation of wiring lines sometimes becomes complicated.

Besides, since the electric power consumption of the printing head employing the above heaters is comparatively large (several tens W-about 100 W), the width of wiring line need to be maintained at a sufficient scale, in case of feeding the corresponding electric power without increasing the number of the wiring lines. This incurs the problem that the wiring board enlarges to increase the size of the printing head.

Secondly, in the TAB method, electrodes are connected to exposed electrode terminals at a connection part between the printed wiring board and the printing element board. Consequently comparatively rigid sealing needs to be performed by increasing an amount of a sealing material. As a result, the sealing material is deposited to form a convex portion on an ejection orifice surface of the printing head. In consequence, the spacing between the printing head and printing paper needs to be held at, at least, a certain magnitude, and the flight distances of ejected ink droplets enlarge to that extent and form a factor for hampering an improvement of a printing precision.

The above problems will be concretely explained with reference to FIGS. 7A and 7B below. These figures are views showing the layout of the electrical connections in the prior-art printing head unit shown in FIG. 5 and FIGS. 6A, 6B, and FIG. 7A is a sectional view taken along line VIIA—VIIA in FIG. 7B.

For the simplification of the description, FIGS. 7A and 7B show cases where three electrodes for feeding signals or electric power to the printing element board 10. According to this arrangement, three bump electrodes 40 are disposed on each of both the sides of the printing element board 10, and three electrode wiring lines 31 of a flexible board 30 are respectively connected to the three bump electrodes 40 by the TAB method. After the connections, respective connection parts are sealed with a sealant 70, as shown in the figures.

In the wiring layout, when the wiring lines 31 on the right side and the wiring lines 31 on the left side as are respectively symmetric with respect to the printing element board 10 feed the same signals or power levels, they are made common In prior-art cases, however, they have been made common on the side of the apparatus main body. More specifically, since the connections of the wiring lines 31 adopt the TAB method, these wiring lines 31 are difficult to be multilayered, and they cannot be made common in the vicinity of the connection parts with the printing element board 10. Therefore, the flexible board is mostly formed bearing the respective right and left wiring lines as the separate ones. As a result, the sorts of signals, etc. cannot be increased, or the width of the board itself needs to be enlarged for the purpose of ensuring predetermined sorts of signals, etc.

Further, as seen from FIG. 7A, comparatively rigid sealing is effected with the sealant 70, and the convex part of the sealant 70 are formed on the ejection orifice surface of the printing element board 10. For this reason, a sufficient distance needs to be set so that printing paper which is fed for printing may be prevented from touching the convex portion of the printing head. Herein, since the distance between the printing head and the printing paper is large in this manner, a landing precision of ejected ink droplets lowers, with the result that degradation in a printing quality is sometimes incurred.

SUMMARY OF THE INVENTION

An object of the present invention is to provide a printing head and an ink jet printing apparatus of high reliability in which the number or density of the electrode wiring lines of a wiring board for feeding signals, etc. to a printing element board can be increased by a simple arrangement.

In the first aspect of the present invention, there is provided a printing head for ejecting ink, comprising:

a printing element board including an energy generating element for generating energy used for ejecting the ink;

a wiring board used for supplying an electric signal or an electric power from an apparatus main body to the printing element board, the wiring board including an electrode wiring line connected with an electrode of the printing element board to supply the electric signal or an electric power; and a supporting member supporting the printing element board, the supporting member being formed with an electrode wiring line for connecting the electrode wiring lines, which supply the electric signal of the same kind or the electric power of the same kind, with each other among the electrode wiring lines connected with the electrode of the printing element board.

Preferably, the connection of the electrode wiring line of the wiring board with the electrode of the printing element board may be made in a state in which the electrode wiring line is entirely covered with the wiring board.

In the second aspect of the present invention, there is provided an ink jet printing apparatus which employing a printing head to eject ink to a printing medium for performing printing, wherein the printing head comprises:

a printing element board including an energy generating element for generating energy used for ejecting the ink;

a wiring board used for supplying an electric signal or an electric power from an apparatus main body to the printing element board, the wiring board including an electrode wiring line connected with an electrode of the printing element board to supply the electric signal or an electric power; and a supporting member supporting the printing element board, the supporting member being formed with an electrode wiring line for connecting the electrode wiring lines, which supply the electric signal of the same kind or the electric power of the same kind, with each other among the electrode wiring lines connected with the electrode of the printing element board.

Preferably, the connection of the electrode wiring line of the wiring board with the electrode of the printing element board may be made in a state in which the electrode wiring line is entirely covered with the wiring board.

According to the above configuration, in the wiring board for feeding signals and the like to the printing element board, a plurality of electrode wiring lines of an identical sort, for example, for feeding supply power are interconnected by the electrode wiring line in the supporting member, and hence, a part of the electrode wiring lines of the identical sort for feeding the power can be omitted in the wiring board, whereby a space for laying the other electrode wiring lines can be relatively enlarged in the wiring board. In other words, according to the present invention, the supporting member for supporting the printing element board is utilized to be provided with an electrode wiring line for making common the electrode wiring lines in the wiring board, whereby the electrode wiring lines in the wiring board can be, in effect, multilayered. Moreover, the electrode wiring lines of the wiring board are connected with the electrodes of the printing element board in a state where they are entirely covered within the wiring board itself, so that the quantity of the sealant used for connections can be lessened.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described in detail with reference to the drawings.

(Embodiment 1)

Figure 1A:
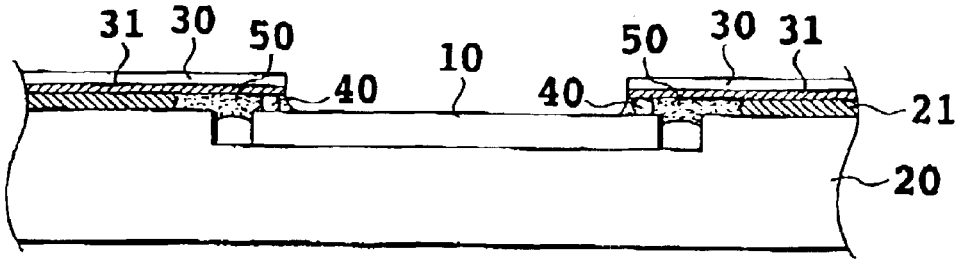
FIGS. 1A, 1B and 1C are views for explaining the electrical connections between a printing element board and a flexible board in a printing head according to the first embodiment of the present invention.
Figure 1B:
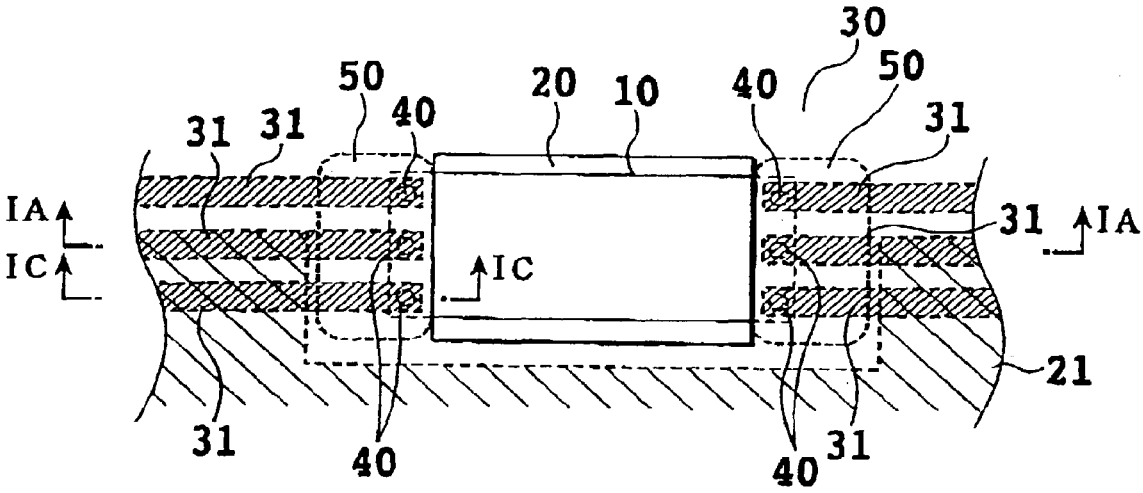
Figure 1C:
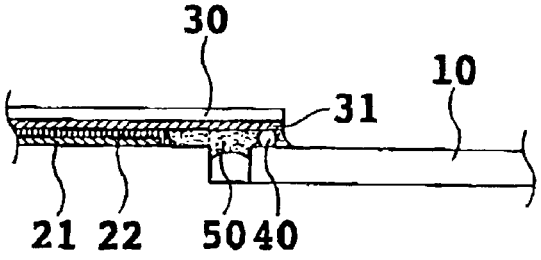

FIGS. 1A, 1B and 1C are views showing the details of the electrical connections between a printing element board and a flexible wiring boards in a printing head according to the first embodiment of the present invention. Herein, FIG. 1A shows a sectional view taken along line IA—IA in FIG. 1B, and FIG. 1C a sectional view taken along line IC—IC in FIG. 1B.

The printing head of this embodiment is similar to the printing head shown in FIGS. 6A, 6B and FIGS. 7A, 7B, and thus in FIGS. 1A–1C, identical reference numerals are assigned to the same elements or components as shown in FIGS. 6A, 6B, and 7A, 7B. This embodiment differs from the prior-art example shown in FIGS. 6A and 6B, etc., in a configuration of electrical connection parts between a printing element board and a flexible board, and in a configuration of the flexible board corresponding to the configuration of electrical connection. More specifically, in a flexible board 30, electrode wiring lines 31 thereof are entirely covered within the body of the flexible board, that is, they have no exposed part. In correspondence with this arrangement, the printing element board 10 is provided with bump electrodes 40 as in the prior-art example. Then, the electrode wiring lines 31 and the bump electrodes 40 are bonded to each other by an organic resin 50 which contains conductive particles. The flexible board 30 is formed with an opening at a portion corresponding to the printing element board 10, as shown in FIG. 1B, and most part of the printing element board 10 and a part of the supporting board 20 supporting the board 10 are exposed through the opening.

A supporting board 20 serving as a supporting member is an insulating board, and an electrode wiring line 21 is formed on the supporting board 20. FIG. 1B is a view showing the electrode wiring line 21 in plan. As seen from this figure, the electrode wiring line 21 connects the wiring lines 31 at center positions on both the sides of the printing element board 10 to each other, among the three sorts of electrode wiring lines 31 of the flexible board 30, so as to makes the central wiring lines 31 common. In this embodiment, the central wiring lines 31 serve to supply the electric power of a power source from an apparatus main body. These electrode wiring lines are similarly bonded to each other by the organic resin 50. Incidentally, regarding those of the three sorts of electrode wiring lines 31 which are not electrically connected with the electrode wiring line 21, insulating layers 22 are formed on the electrode wiring line 21 in correspondence with the pertinent wiring lines 31 as shown in FIG. 1C. More specifically, the insulating layers 22 are disposed on substantially the same location as the electrode wiring line 21 in FIG. 1B, but are not disposed on portions corresponding to the electrode wiring lines 31 at the center positions, as shown in FIG. 1A.

In this manner, an electrode wiring line is laid on the supporting member so that certain wiring lines of the flexible board which are connected with electrode terminals of the printing element board are made common. Thus, it is possible to vacate a region which the flexible board has heretofore required for disposing one of the electrode wiring lines 31 to be made common in the embodiment. It is consequently permitted to lay a larger number of electrode wiring lines or make the width of the electrode wiring line per se, without enlarging the width of the flexible board.

Besides, the connections between bump electrodes of the printing element board and the wiring lines of the flexible board are not made in a state where the electrode wiring lines are exposed as in the prior art, and therefore, a large quantity of sealant is not required. As a result, comparatively large convex portion can be prevented from being formed on the ejection orifice surface of the printing head, and then the distance between the printing head and printing paper can be set small.

(Embodiment 2)

Figure 2A:
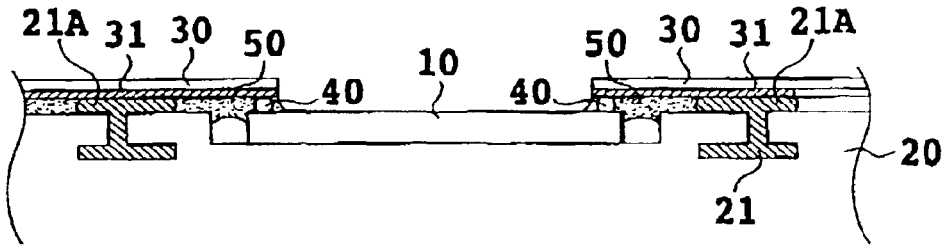
FIGS. 2A, 2B and 2C are views for explaining the electrical connections between a printing element board and a flexible board in a printing head according to the second embodiment of the present invention.
Figure 2B:
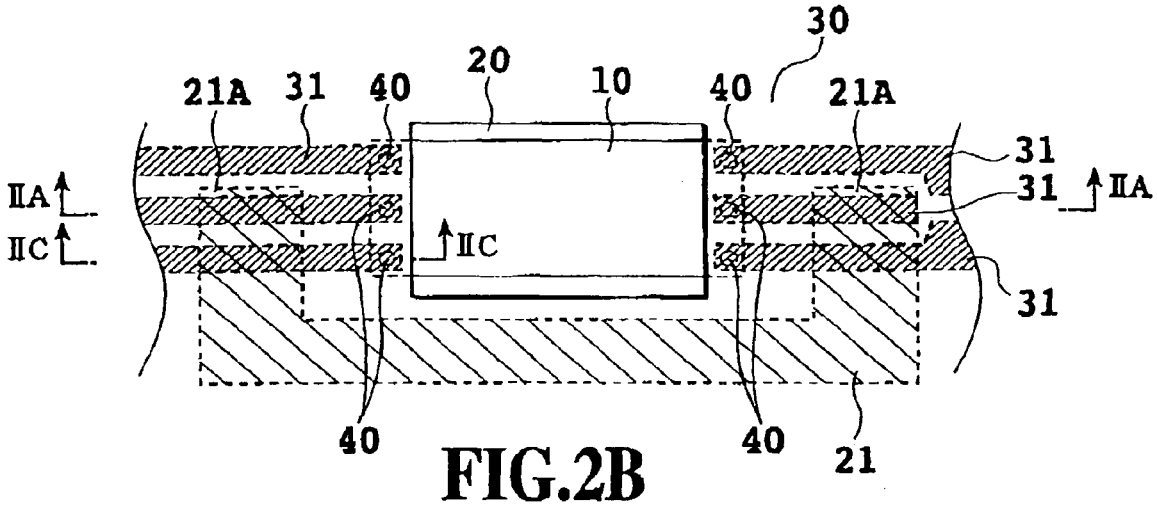
Figure 2C:
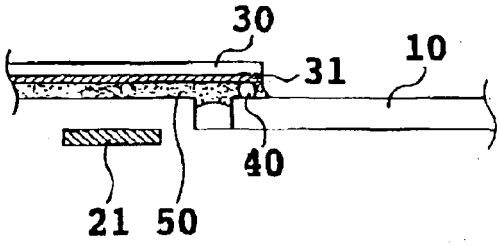

This embodiment relates to an aspect in which the electrode wiring line 21 which is formed on the supporting board 20 is formed in multilayered fashion FIGS. 2A, 2B and 2C are views showing the details of the electrical connections between a printing element board and a flexible wiring board in a printing head according to this embodiment.

As shown in these figures, only those parts of the electrode wiring line 21 which are connected with wiring lines 31 are formed as double layers. More specifically, the part of the electrode wiring line 21 other than the parts thereof connected with the wiring lines 31 is buried in the supporting board 20, and only connection parts 21A thereof are exposed. Thus, the connections between the electrode wiring line 21 and the wiring lines 31 can be facilitated.

Incidentally, since the multi-layering of the electrode wiring line 21 in the supporting board 20 is comparatively easy in a manufacturing process, more complicated arrangement of wiring line can be achieved.

(Embodiment 3)

Figure 3A:
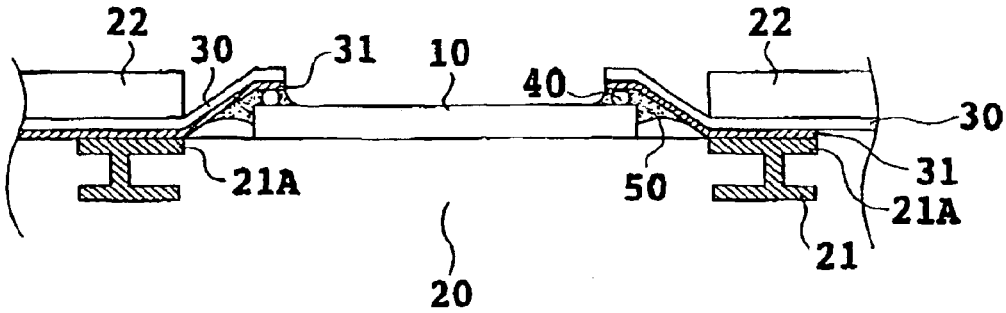
FIGS. 3A, 3B and 3C are views for explaining the electrical connections between a printing element board and a flexible board in a printing head according to the third embodiment of the present invention.
Figure 3B:
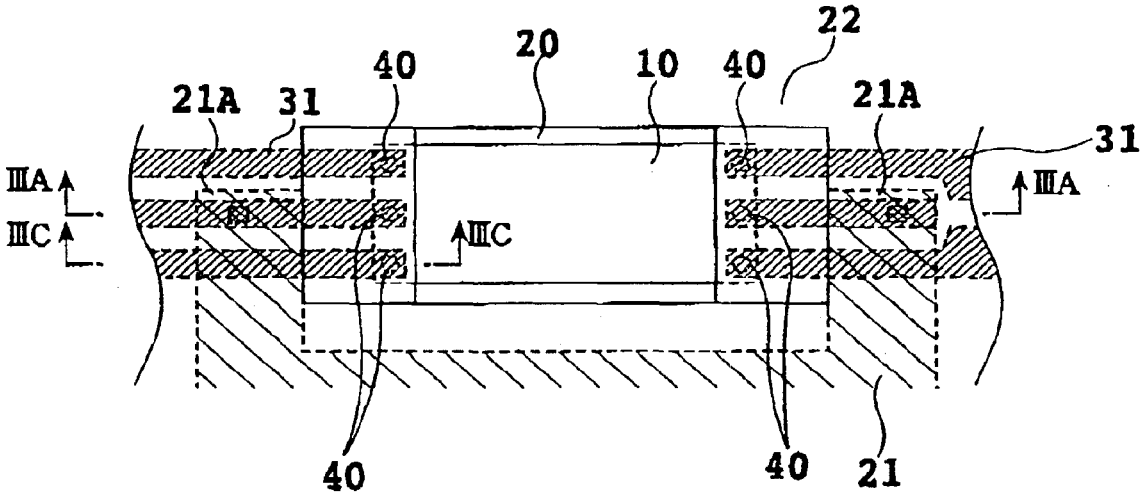
Figure 3C:
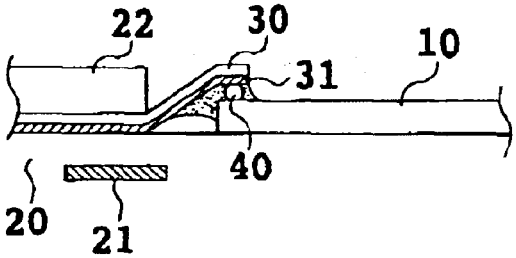

This embodiment relates to a modification to Embodiment 2 described above, and consists in that the flexible board is substantially entirely covered with an insulating board which is of the same material as that of the supporting board. FIGS. 3A, 3B and 3C are views showing the details of electrical connections in this modified embodiment.

As shown in these figures, a supporting board 20 and an insulating board 22 of the same material as that of this supporting board 20 are disposed so as to sandwich a flexible board 30 therebetween. Thus, the board 22 forms the outermost surface of the printing head. That is, a smooth surface is formed around the ejection orifice surface of the printing head by the board 22.

As a result, a cap for capping in a non-printing mode abuts favorably on the printing head owing to the smooth surface.

Figure 4:
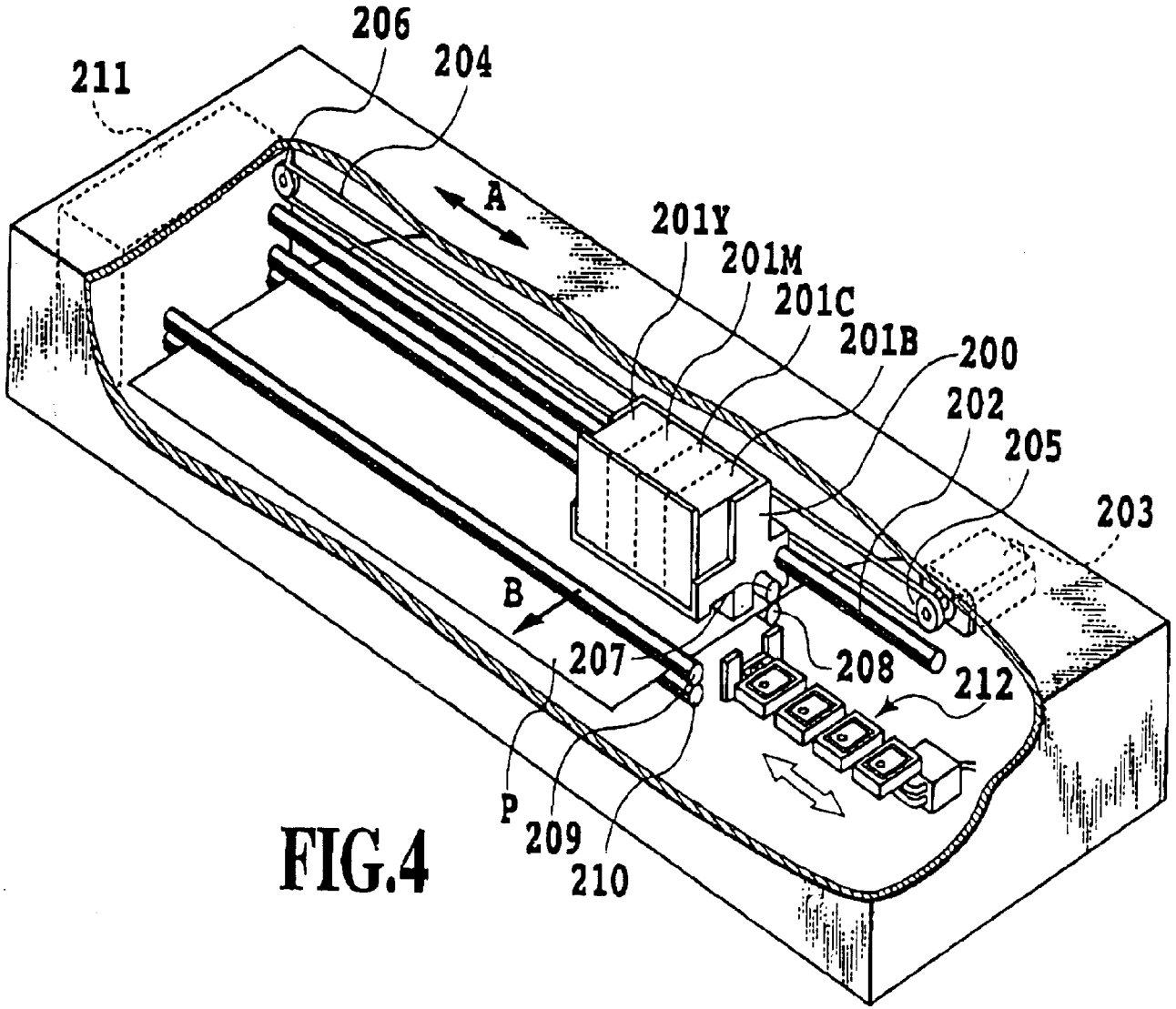
FIG. 4 is a perspective view showing an ink jet printer which performs printing with the printing heads according to any one of the embodiments of the present invention.
Figure 5:
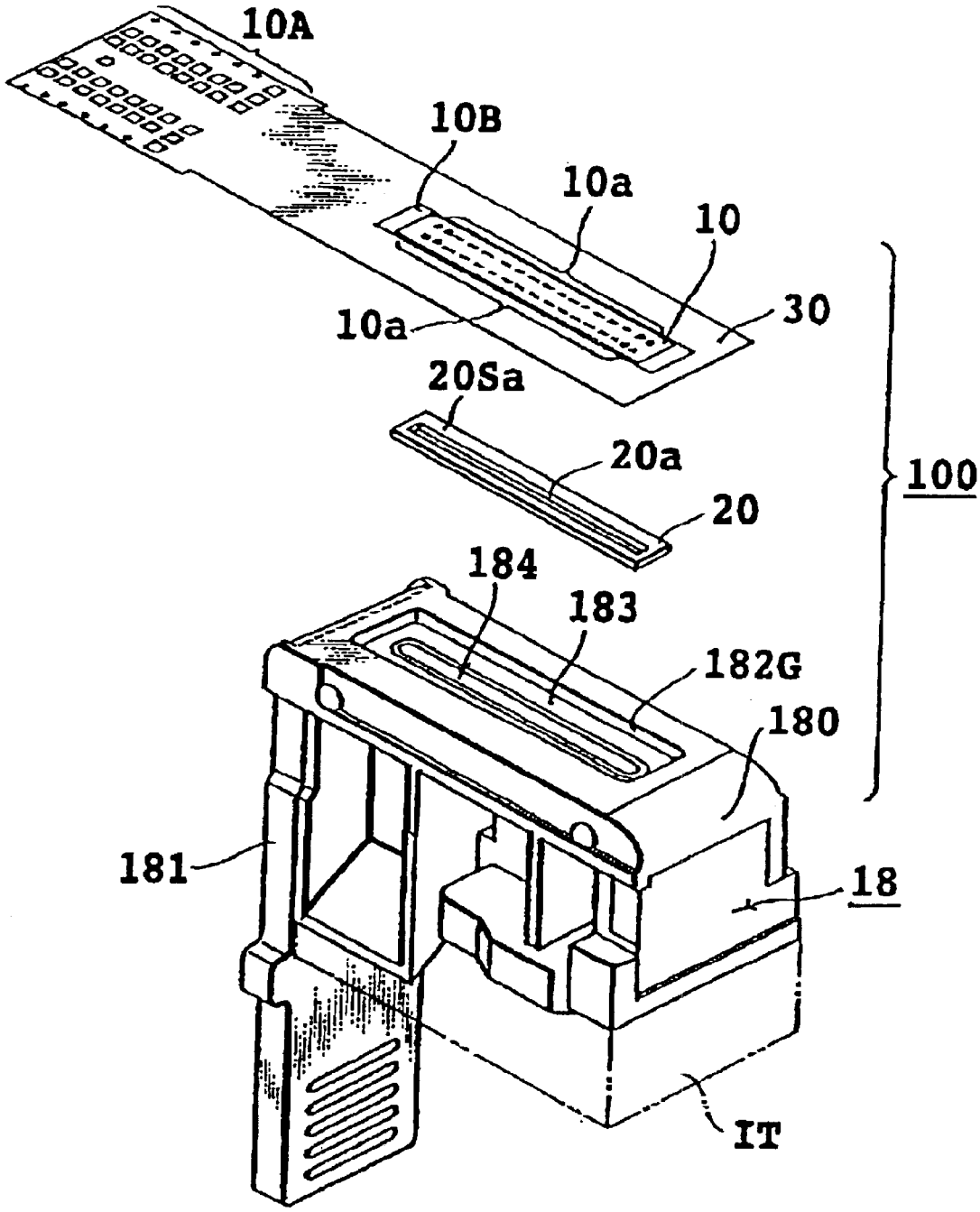
FIG. 5 is an exploded perspective view showing a printing head in a prior-art example, especially the construction of a printing element board as well as a flexible board.
Figure 6A:
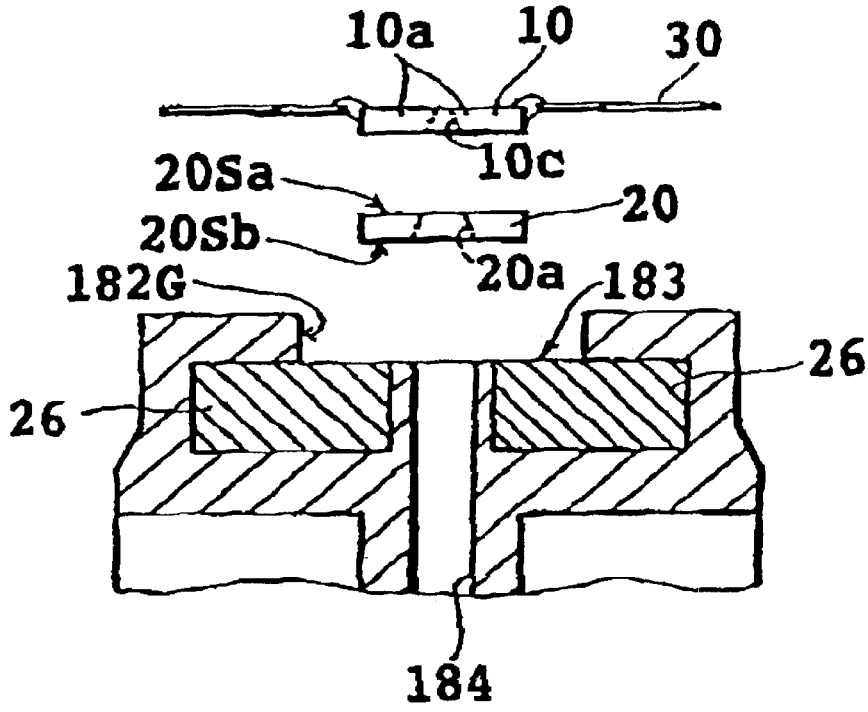
FIGS. 6A and 6B are sectional views showing the structure of the prior-art printing head.
Figure 6B:
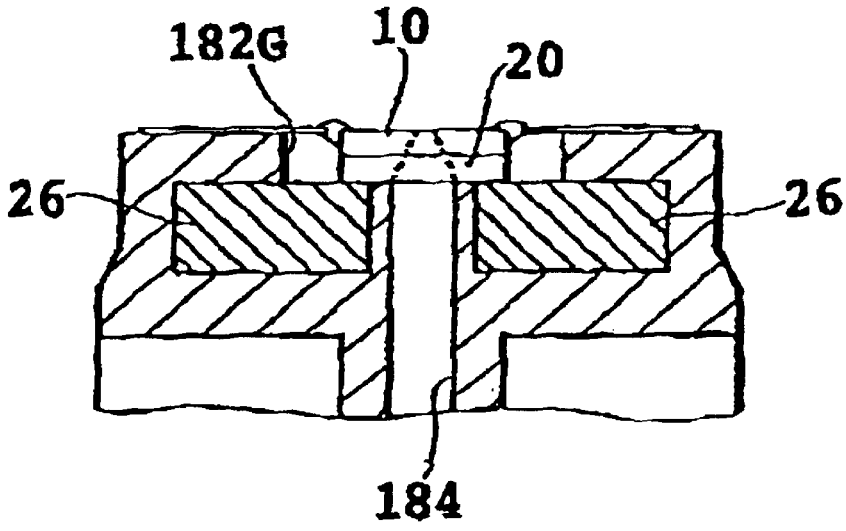
Figure 7A:
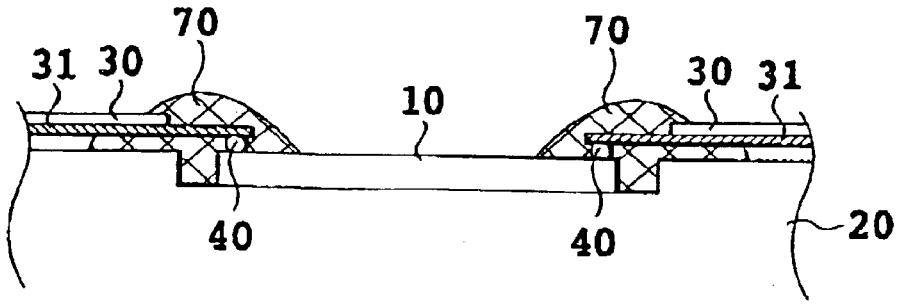
FIGS. 7A and 7B are views for explaining the electrical connections between the printing element board and the flexible board in the prior-art printing head.
Figure 7B:
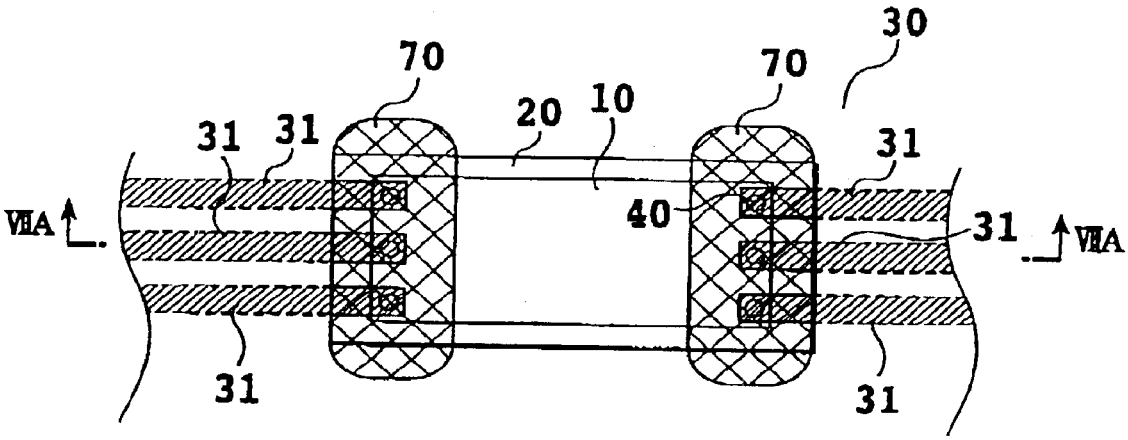

FIG. 4 is a perspective view showing a printer as an ink jet printing apparatus which is capable of performing printing by mounting the printing heads in the form of any of the embodiments described above.

Referring to FIG. 4, inkjet units 201Y, 201M, 201C and 201B each of which is constructed of the printing head described in any of the foregoing embodiments, and an ink tank, are mounted on a carriage 200. More specifically, the printing heads are respectively used for ejecting inks in the colors of yellow (Y), magenta (M), cyan (C) and black (B).

The carriage 200 is held in slidable engagement with a guide shaft 202, and the driving force of a carriage motor 203 is transmitted through a belt extended over pulleys 205, 206, whereby the carriage 200 can move for scanning along the guide shaft 202. Recovery units 212 each of which includes a cap or the like for executing a recovery process for the corresponding printing head are disposed at one end of a scanning range of the printing head based on the carriage 200. Besides, printing paper P is fed into a printing region within the scanning range of the printing heads, intermittently in synchronism with the scanning of the printing heads. The paper feed is permitted by a pair consisting of a conveying roller 207 and a pressing roller 208, and a pair consisting of a conveying roller 209 and a pressing roller 210 as are respectively disposed on the upper stream side and lower stream side of the printing region.

Incidentally, one form of the printing head to which the present invention is effectively applied is such that film boiling is induced in ink by utilizing thermal energy generated by an electro-thermal transducer, and that the ink is ejected by the pressure of air bubbles generated by the boiling.

As is apparent from the above description, according to the embodiments of the present invention, in the wiring board for feeding signals and the like to the printing element board, a plurality of electrode wiring lines of an identical sort, for example, for feeding supply power are interconnected by an electrode wiring line in the supporting member, and hence, a part of the electrode wiring lines of the identical sort for feeding the power can be omitted in the wiring board, whereby a space for laying the other electrode wiring lines can be relatively enlarged in the wiring board. In other words, according to the present invention, the supporting member for supporting the printing element board is utilized to be provided with an electrode wiring line for making common the electrode wiring lines in the wiring board, whereby the electrode wiring lines in the wiring board can be, in effect, multilayered. Moreover, the electrode wiring lines of the wiring board are connected with the electrodes of the printing element board in a state where they are entirely covered within the wiring board itself, so that the quantity of the sealant used for connections can be lessened.

As a result, the number or density of the electrode wiring lines of the wiring board for feeding signals, etc. to the printing element board can be increased by a simple configuration.

The present invention has been described in detail with respect to preferred embodiments, and it will now be apparent from the foregoing to those skilled in the art that changes and modifications may be made without departing from the invention in its broader aspect, and it is the intention, therefore, in the appended claims to cover all such changes and modifications as fall within the true spirit of the invention.

What is claimed is:

1. A printing head for ejecting ink, comprising:

a printing element board including an energy generating element for generating energy used for ejecting the ink;

a wiring member used for supplying electric signals or electric power from an apparatus main body to said printing element board, said wiring member including electrode wiring lines connected with respective electrodes of said printing element board to supply the electric signals or electric power; and a supporting member supporting said printing element board, said supporting member being formed with a common electrode wiring line for connecting electrode wiring lines used to supply electric signals of a same kind or electric power of a same kind, among said electrode wiring lines of said wiring member.

2. A printing head as claimed in claim 1, wherein said common electrode wiring line of said supporting member is formed on said supporting member.

3. A printing head as claimed in claim 1, wherein said common electrode wiring line of said supporting member is formed inside said supporting member and only a part of said common electrode wiring line that is connected with said electrode wiring lines of said wiring member is exposed.

4. A printing head as claimed in claim 1, wherein said wiring member is sandwiched between said supporting member and a board forming an outermost surface of said printing head.

5. A printing head as claimed in claim 1, wherein the connection of said electrode wiring lines of said wiring member with said electrodes of said printing element board is made in a state in which said electrode wiring lines are entirely covered with said wiring member.

6. A printing head as claimed in claim 1, wherein said energy generating element generates thermal energy to generate a bubble in the ink and the ink is ejected by pressure of the bubble.

7. An ink jet printing apparatus that employs a printing head to eject ink to a printing medium for performing printing, said printing head comprising:

a printing element board including an energy generating element for generating energy used for ejecting the ink;

a wiring member used for supplying electric signals or electric power from an apparatus main body to said printing element board, said wiring member including electrode wiring lines connected with respective electrodes of said printing element board to supply the electric signals or electric power; and a supporting member supporting said printing element board, said supporting member being formed with a common electrode wiring line for connecting electrode wiring lines used to supply electric signals of a same kind or electric power of a same kind, among said electrode wiring lines of said wiring member.

8. An ink jet printing apparatus as claimed in claim 7, wherein said common electrode wiring line of said supporting member is formed on said supporting member.

9. An ink jet printing apparatus as claimed in claim 7, wherein said common electrode wiring line of said supporting member is formed inside said supporting member and only a part of said common electrode wiring line that is connected with said electrode wiring lines of said wiring member is exposed.

10. An ink jet printing apparatus as claimed in claim 7, wherein said wiring member is sandwiched between said supporting member and a board forming an outermost surface of said printing head.

11. An ink jet printing apparatus as claimed in claim 7, wherein the connection of said electrode wiring lines of said wiring member with said electrodes of said printing element board is made in a state in which said electrode wiring lines are entirely covered with said wiring member.

12. An ink jet printing apparatus as claimed in claim 7, wherein said energy generating element generates thermal energy to generate a bubble in the ink and the ink is ejected by pressure of the bubble.

* * * * *

UNITED STATES PATENT AND TRADEMARK OFFICE

CERTIFICATE OF CORRECTION

PATENT NO. : 6,935,726 B2
DATED : August 30, 2005
INVENTOR(S) : Yasutomo Watanabe It is certified that error appears in the above-identified patent and that said Letters Patent is hereby corrected as shown below:

Column 1,
Line 19, “ink” should read -- ink. --.

Column 3,
Line 24, “shorten” should read -- shortened --.
Line 30, “wiring line” should read -- the wiring lines --.

Column 4,
Line 15, “part” should read -- parts --.

Column 6,
Line 28, “most part” should read -- most --.
Line 39, “makes” should read -- make --.

Column 7,
Line 1, “portion” should read -- portions --.
Line 8, “fashion” should read -- fashion. --.

Signed and Sealed this

Seventh Day of February, 2006

JON W. DUDAS
*Director of the United States Patent and Trademark Office*